US009399245B2

(12) United States Patent
Holm et al.

(10) Patent No.: US 9,399,245 B2
(45) Date of Patent: Jul. 26, 2016

(54) METHOD OF FLATNESS CONTROL OF A STRIP AND A CONTROL SYSTEM THEREFOR

(75) Inventors: Markus Holm, Vasteras (SE); Per-Erik Moden, Vasteras (SE)

(73) Assignee: ABB Research Ltd., Zurich (CH)

( * ) Notice: Subject to any disclaimer, the term of this patent is extended or adjusted under 35 U.S.C. 154(b) by 648 days.

(21) Appl. No.: 13/431,641

(22) Filed: Mar. 27, 2012

(65) Prior Publication Data

US 2012/0253502 A1 Oct. 4, 2012

(30) Foreign Application Priority Data

Mar. 28, 2011 (EP) ..... 11160050

(51) Int. Cl.

| | |
|---|---|
| ***B21B 37/28*** | (2006.01) |
| ***B21B 37/42*** | (2006.01) |
| ***B21B 38/02*** | (2006.01) |
| ***B21B 37/32*** | (2006.01) |
| ***B21B 37/38*** | (2006.01) |
| ***B21B 13/14*** | (2006.01) |
| *B21B 37/30* | (2006.01) |

(52) U.S. Cl.

CPC ..... *B21B 37/28* (2013.01); *B21B 13/147* (2013.01); *B21B 37/30* (2013.01); *B21B 38/02* (2013.01)

(58) Field of Classification Search

None

See application file for complete search history.

(56) References Cited

U.S. PATENT DOCUMENTS 3,802,236 A * 4/1974 Smith, Jr. ..... B21B 37/16 72/11.8
4,494,396 A * 1/1985 Iwanami ..... B21B 13/145 72/241.6

(Continued)

FOREIGN PATENT DOCUMENTS

| | | | |
|---|---|---|---|
| WO | 2005064270 | A1 | 7/2005 |
| WO | 2006002784 | A1 | 1/2006 |
| WO | 2006132585 | A1 | 12/2006 |

OTHER PUBLICATIONS

John V. Ringwood, "Shape Control Systems for Sendzimir Steel Mills", Jan. 2000, IEEE Transactions on Control Systems Technology, vol. 8, No. 1, pp. 70-86.*

(Continued)

*Primary Examiner* — Sean Shechtman
*Assistant Examiner* — Jay Jung
(74) *Attorney, Agent, or Firm* — Whitmyer IP Group LLC

(57) ABSTRACT

A method of providing flatness control for rolling a strip in a mill including a plurality of rolls controllable by actuators. The method includes the steps of: receiving flatness measurement data pertaining to a flatness of the strip; determining a flatness error as a difference between a reference flatness of the strip and the flatness measurement data; determining an adjusted flatness error based on the flatness error and weights for actuator position combinations which provide a flatness effect below a threshold value; and utilizing the adjusted flatness error for the control units to control the actuators to thereby control the flatness of the strip. A computer program product and a control system for carrying out the above method are also presented herein.

19 Claims, 2 Drawing Sheets

(56) References Cited

U.S. PATENT DOCUMENTS 4,539,833 A * 9/1985 Kato ..... B21B 13/145 72/243.4
5,090,194 A * 2/1992 Richards ..... F01D 17/26 137/625.23
5,509,285 A * 4/1996 Anbe ..... B21B 37/28 72/201
5,680,784 A 10/1997 Tateno et al.
5,684,375 A * 11/1997 Chaffee ..... G05B 13/024 318/565
6,158,260 A * 12/2000 Ginzburg ..... B21B 37/28 72/11.7
6,199,418 B1 * 3/2001 Tezuka ..... B21B 37/28 72/11.7
6,401,506 B1 * 6/2002 Ogawa ..... B21B 37/16 72/10.4
2003/0011923 A1 * 1/2003 Stevens ..... G11B 5/4886 360/78.05
2003/0105247 A1 * 6/2003 Braganca ..... C08F 10/02 526/61
2006/0293797 A1 * 12/2006 Weiler ..... A01G 25/16 700/284
2008/0202148 A1 * 8/2008 Gagliano ..... B67D 1/0406 62/392
2009/0105850 A1 * 4/2009 Miyata ..... G05B 19/042 700/28
2009/0277241 A1 * 11/2009 Jonsson ..... B21B 37/28 72/9.2
2010/0193623 A1 * 8/2010 Botta ..... B21B 37/48 242/418
2010/0286959 A1 * 11/2010 Novis ..... F15B 15/2815 702/183
2012/0253502 A1 * 10/2012 Holm ..... B21B 13/147 700/154

OTHER PUBLICATIONS

European Search Report; Application No. EP 11 16 0050; Issued: Sep. 7, 2011; Mailing Date: Sep. 19, 2011; 5 pages.

* cited by examiner

METHOD OF FLATNESS CONTROL OF A STRIP AND A CONTROL SYSTEM THEREFOR

CROSS-REFERENCE TO RELATED APPLICATIONS

The present application claims priority of European patent application No. 11160050.8 filed on Mar. 28, 2011, the content of which is incorporated herein by reference.

FIELD OF THE INVENTION

The present invention generally relates to the control of rolling a strip in a mill, and in particular to a method of providing flatness control for rolling a strip, and a control system and computer program product for carrying out the method.

BACKGROUND OF THE INVENTION

Strips such as steel strips, or strips made of other metals, can be subjected to a thickness reduction process e.g. by cold rolling or hot rolling in a mill. The work piece, i.e. the strip, is uncoiled from an uncoiler, processed in the mill, and coiled onto a coiler.

A mill comprises rolls with one set of rolls being arranged above the strip and another set of rolls being arranged below the strip when the strip passes through the mill. The mill is arranged to receive the strip between two work rolls forming a roll gap. The remaining rolls provide additional control and pressure to the work rolls, thereby controlling the roll gap profile and hence the flatness of the strip as it moves through the roll gap.

A cluster mill comprises a plurality of rolls stacked as layers above and below the work rolls. Backup rolls, i.e. the uppermost rolls of the rolls arranged above the roll gap and the lowermost rolls of the rolls arranged below the roll gap, may be segmented. Each roll segment may be moved in and out of the mill by means of crown actuators. The movements of the segmented rolls permeate through the cluster of rolls toward the work rolls for forming the strip moving through the roll gap. The remaining rolls of the cluster mill may also be actuated by means of their respective actuators. Bending actuators may for instance provide bending effects to a roll to which they are assigned and thereby change the profile of the roll gap. Side-shift rolls may have non-cylindrical shape which alters the roll gap profile by means of axial displacement of the side-shift rolls via side-shift actuators.

A uniform flatness across the width of the strip is typically desired as a non-uniform flatness may e.g. result in the manufacture of a strip having lower quality than a strip having an essentially uniform flatness profile. A strip having non-uniform flatness may for instance become buckled or partially corrugated. Non-uniform flatness may also cause strip breaks due to locally increased tension. Therefore, the flatness profile of the strip is measured, e.g. by measuring the force applied by the strip to a measurement roll, prior to the strip is coiled onto the coiler, wherein the measured flatness data is provided to a control system which controls the actuators of the mill for controlling the roll gap of the mill such that uniform flatness of the strip may be obtained.

In order to control the actuators, the mill is generally modeled by means of a flatness response function for each of the actuators of the mill. These can e.g. be gathered as columns in a matrix, sometimes referred to as the mill matrix, $G_m$.

In a mill having a plurality of actuators, such as a cluster mill, one may have linear dependence among the flatness responses. This means that there may be actuator position combinations which do not affect the flatness of the strip because the combined flatness response provided by the actuators cancel the flatness effects provided by each individual actuator.

For mills in which the above-described situation may arise, the corresponding mill matrix is said to be singular. In mathematical terms, a singular mill matrix does not have full rank, i.e. the mill matrix null space has a dimension greater than zero.

A classical control approach involves one control loop per actuator, with the flatness error vector projected to one value per control loop. For mills having a singular mill matrix this leads to such movement of the actuators that in some cases the flatness of the strip will not be affected, because the error projection allows all possible actuator position combinations. This corresponds to actuator movement in the null space of the mill matrix. Repeated disturbances will cause the actuators to drift along the directions which do not directly influence the flatness. There is also a risk that these actuator movements get far too large. These two cases of unwanted behavior may cause the actuators to saturate, but also cause unnecessary actuator load and wear.

In order to address this problem, the mill matrix $G_m$ may be represented in the form of its singular value decomposition $G_m=U\Sigma V^T$. The singular values of $G_m$, which form the diagonal of $\Sigma$ obtained from the singular value decomposition, provide information of the magnitude of the flatness response provided by each of the actuator position combinations, as defined by the column vectors of the orthonormal matrix V to flatness shapes as defined by the columns of the orthonormal matrix U. Moreover, the singular value decomposition provides information regarding actuator positions which do not directly influence the flatness profile of the roll gap, i.e. the null space.

By parameterizing the flatness error using the flatness response in the directions which do influence the flatness, and by mapping the controller outputs utilizing only those directions which do influence the flatness, movement of actuators in directions which do not influence the flatness may be blocked. Thus, actuator position combinations which do not affect the flatness profile of the roll gap will be avoided.

Singular value decomposition of the mill matrix has been described in for instance "Shape Control Systems for Sendzimir Steel Mills" by John V. Ringwood and published in IEEE Transactions on Control Systems Technology. Vol. 8, No. 1, January 2000.

By utilizing singular value decomposition as described above to avoid combinations of the actuator positions which does not affect the flatness of the strip, not all degrees of freedom of control will be available for control in the sense that some combinations of actuator positions will not be allowed. Therefore control performance may suffer. Moreover, it may also be difficult to tune the separate control loops satisfyingly, since each control loop involves several actuators and therefore have more complex dynamics.

In view of the above, there is hence a need to provide better flatness control of a strip in mills having such a configuration that movement of several actuators in some cases does not affect the flatness of the strip.

SUMMARY OF THE INVENTION

A general object of the present invention is to improve flatness control when rolling a strip in a mill.

Another object of the present invention is to improve the flatness control when rolling a strip in a mill having a singular mill matrix.

In a first aspect of the present invention these objects are achieved by a method of providing flatness control for rolling a strip in a mill comprising a plurality of rolls controllable by means of actuators, the method comprising:

a) receiving flatness measurement data pertaining to a flatness of the strip, b) determining a flatness error as a difference between a reference flatness of the strip and the flatness measurement data, c) determining an adjusted flatness error based on the flatness error and weights for actuator position combinations which provide a flatness effect below a threshold value, and d) utilizing (S4) the adjusted flatness error for controlling the actuators to thereby control the flatness of the strip.

By an actuator is generally meant a set of actuators which control one roll or a roll segment of a segmented roll, such as a backup roll.

By means of determining an adjusted flatness error based on the flatness error and weights for actuator position combinations which provide a flatness effect below a threshold value, the control process will generally not utilize actuator position combinations which correspond to vectors or directions in the null space of the model, e.g. the null space of the mill matrix. However, in some situations the actuator position combinations which correspond to vectors in the null space of the model may be allowed, i.e. the criterion of equation (2) will in some cases be minimized by allowing such actuator position combinations. Thereby usage of all possible actuator position combinations, i.e. all degrees of freedom of the control system which implements the present method, can be utilized. In particular, the invention uses one control loop per actuator. Therefore, constraints that affect one actuator do not restrict the other actuators from moving. Moreover, there is no need for separate tuning of virtual actuators, since there are not any.

An actuator position combination is herein defined as a set of actuator positions including each actuator of the mill. An actuator position combination does not provide a flatness effect to a strip if the actuator position combination corresponds to a vector in the null space of the mill matrix. All other actuator position combinations provide a flatness effect to a strip.

Step c) may comprise providing constraints to control unit outputs controlling the actuators.

Step c) may comprise providing weights on the adjusted flatness error.

Step c) may comprise providing weights on the control unit outputs.

The determining in step c) may comprise utilizing the flatness error to determine a difference between the flatness error and a mapping of the adjusted flatness error by means of a model representing the mill.

The determining of the adjusted flatness error may involve a minimization.

The weights may provide individual weights for each actuator position combination.

Thereby the amount of the flatness error which is projected to low gain directions may be reduced selectively. Here low gain directions correspond to actuator position combinations which provide low or no flatness effect.

The determining in step c) may comprise providing additional weights to actuator position differences for optimizing the positioning between the actuators.

The determining in step c) may comprise providing additional weights for deviations from preferred positions of actuators.

Since all degrees of freedom are present, optimization of actuator positioning is possible. Additional criteria terms may for instance provide penalty for differences between adjacent actuators, if this is unfavorable regarding wear to have them very different. Sometimes there will be a preferred position for an actuator, or a number of actuators. In such cases optimization may include a cost, i.e. a weight, for deviating from that position.

The determining of the adjusted flatness error may involve taking all possible actuator position combinations into account.

The weights may be adjustable by a user via a user interface. Thereby users, e.g. commissioning engineers, may in a simplified way be able to understand the control of the control units and provide tuning thereof without the need to understand the complicated multivariable control problem.

In a second aspect of the present invention there is provided a computer program product comprising a computer readable medium storing program code which when executed performs the method according to the first aspect of the present invention.

According to a third aspect of the present invention there is provided a control system for providing flatness control for rolling a strip in a mill comprising a plurality of rolls controllable by means of actuators, wherein the control system comprises:

an input unit arranged to receive measurement data pertaining to a flatness of the strip, and a processing system arranged to determine a flatness error as a difference between a reference flatness of the strip and the measurement data; to determine an adjusted flatness error based on the flatness error and weights for actuator position combinations which provide a flatness effect below a threshold value, and a control unit, wherein the processing system is arranged to provide the adjusted flatness error to the control unit, which control unit is arranged to control the actuators based on the adjusted flatness error.

The control unit may be arranged to provide individual control outputs to each of the actuators.

One embodiment may comprise one control loop per actuator.

Additional features and advantages will be disclosed in the following.

BRIEF DESCRIPTION OF THE DRAWINGS

The invention and the advantages thereof will now be described by way of non-limiting examples, with reference to the accompanying drawings of which.

DETAILED DESCRIPTION OF THE INVENTION

Figure 1:
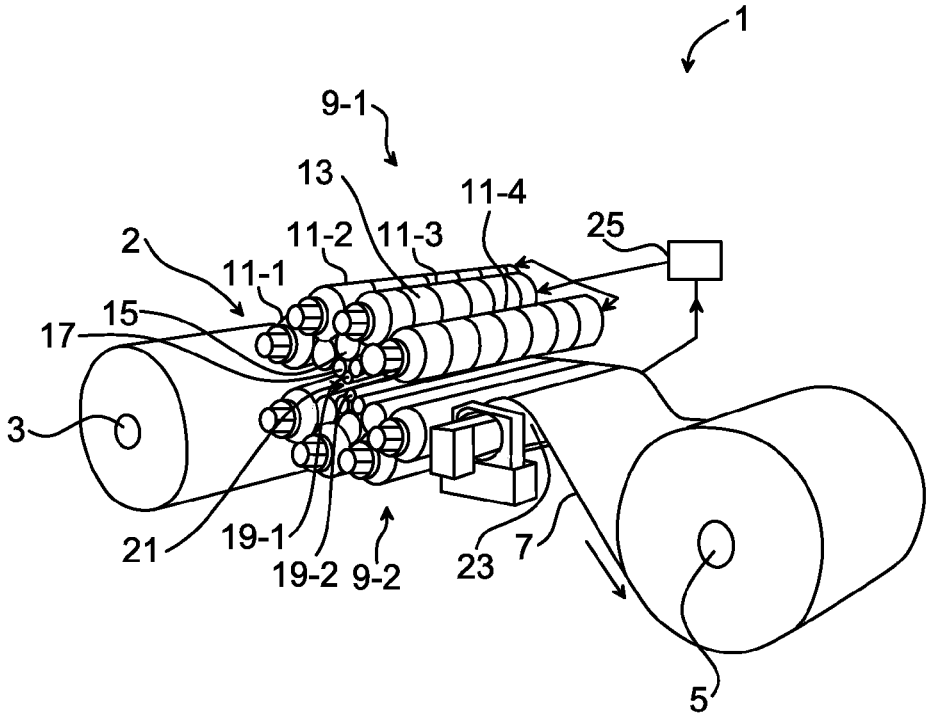
FIG. 1 is a perspective view of a cluster mill.

FIG. 1 shows a perspective view of a roll arrangement 1. The roll arrangement comprises a cluster mill 2, an uncoiler 3 and a coiler 5. The cluster mill 2, hereafter referred to as mill 2, may be used for rolling hard materials, e.g. for cold rolling a metal strip.

A strip 7 may be uncoiled from the uncoiler 3 and coiled onto the coiler 5. The strip 7 is subjected to a thickness reduction process by means of the mill 2 as the strip 7 moves from the uncoiler 3 to the coiler 5.

The mill 2 comprises a plurality of rolls 9-1 and 9-2, including work rolls 19-1 and 19-2, respectively. The rolls 9-1 form a cluster of upper rolls above the strip 7. The rolls 9-2 form a cluster of lower rolls below the strip 7. The exemplified mill 2 is a 20-high mill with the rolls 9-1 and 9-2 arranged in a 1-2-3-4 formation above and below the strip 7, respectively. It is however to be noted that the present invention is likewise applicable to other types of mills.

Each roll may be actuated by means of actuators (not shown) in order to deform the work rolls 19-1 and 19-2 and thereby adjust a roll gap 21 which is formed between the work rolls 19-1 and 19-2. The process of thickness reduction the strip 7 is obtained when the strip passes the roll gap 21. The work rolls 19-1 and 19-2 are hence in contact with the strip 7 when the strip 7 moves through the mill 2.

Each of the plurality of rolls 9-1 and 9-2 comprise backup rolls, such as backup rolls 11-1, 11-2, 11-3 and 11-4, forming an outer set of rolls of the mill 2. Each backup roll is segmented into a plurality of segments 13. Each of the segments 13 may be controlled by actuators. The segments 13 may by means of actuators be moved towards, or away from, the work rolls 19-1, 19-2. The movement of the rotating segments 13 permeates through the cluster of rolls toward the work roll 19-1 and/or work roll 19-2 for forming the strip 7 moving through the roll gap 21.

In order to provide additional control of the thickness reduction process of the strip 7, the rolls 9-1 and 9-2 further comprise intermediate rolls 15 and 17 arranged between the work rolls 19-1, 19-2 and the backup rolls 11-1, 11-2, 11-3, 11-4. The intermediate rolls 15 and 17 may for instance have bending actuators and/or side-shift actuators, respectively.

The roll arrangement 1 further comprises a measurement device 23, exemplified herein by a measurement roll. The measurement device 23 has an axial extension which is wider than the width of the strip 7 to enable force measurement along the width of the strip 7.

The measurement device 23 comprises a plurality of sensors. The sensors may for instance be distributed in openings in the peripheral surface of the measurement device for sensing the forces applied by the strip to the measurement device. As the strip 7 moves over the measurement device 23, a strip tension profile may by means of the sensors be obtained. A strip tension profile having an even force distribution indicates that the strip has a uniform thickness along its width. A strip tension profile which is non-uniform indicates that the strip has a non-uniform flatness along its width at the associated measured position of the strip.

Figure 2:
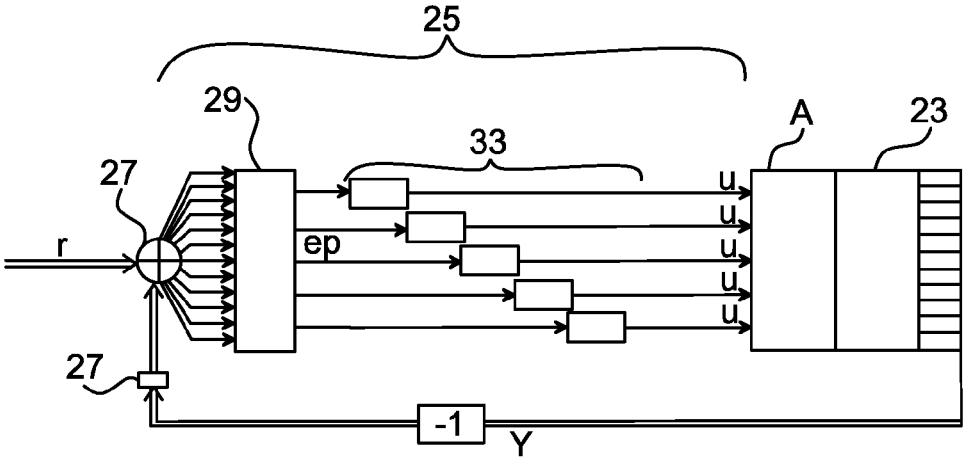
FIG. 2 is a block diagram of a control system.

The measured strip tension profile, translated into a deduced flatness profile, is provided by the measurement device 23 as measurement data Y to a processing system 29 of control system 25 in FIG. 2.

Figure 3:
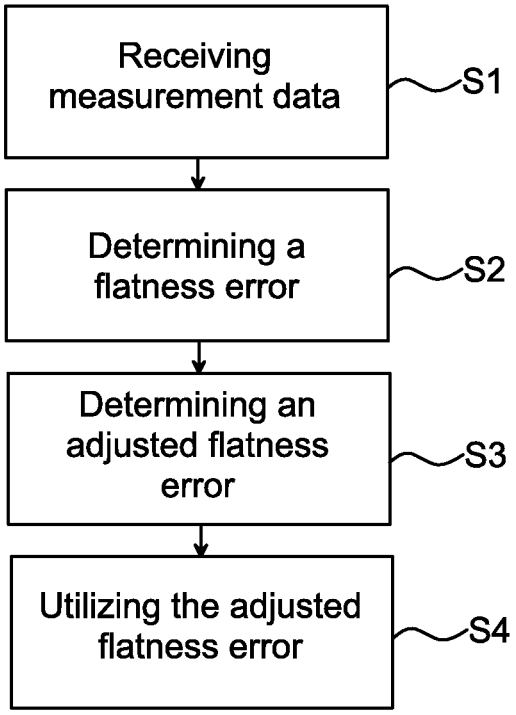
FIG. 3 is a flow chart illustrating a method of providing flatness control for rolling a strip in a mill comprising a plurality of rolls controllable by means of actuators.

The measurement data is processed by the control system 25 for controlling the rolls 9-1 and 9-2 by means of the actuators of the mill 2 to thereby provide uniform flatness along the width of the strip 7. A method for providing the flatness control according to the present inventive concept will now be described in more detail in the following with reference to FIGS. 2 and 3.

FIG. 2 shows a schematic block diagram of the control system 25. The control system 25 comprises an input unit 27, a processing system 29, and a control unit 33. The processing system 29 may in one embodiment comprise the control unit 33. Alternatively, the processing system and control unit may be separate units.

The processing system 29 comprises software in order to be able to carry out the present control method.

The control unit 33 is arranged to provide a plurality of control outputs u to actuators A to thereby control the roll gap. In one embodiment, the control unit 33 is arranged to provide an individual control output upper actuator A. Preferably there is one control loop per actuator A.

The control unit 33 may for instance comprise PI regulators which may be implemented in software.

In a step S1, the input unit 27 is arranged to receive measurement data Y from the measurement device 23. The measurement data Y comprises measurements from the plurality of sensors of the measurement device 23. The measurement data Y may be considered to be a vector with each element representing a measurement value of a sensor.

The input unit 27 is arranged to receive reference flatness data r pertaining to a desired reference flatness of the strip 7. The reference flatness data r is typically a vector comprising the same number of reference values as the number of the measurement values of the measurement data Y.

A flatness error e can be determined by means of the processing system 29 in a step S2 by the difference between the reference flatness of the strip and the measurement data Y.

The flatness error e is adjusted to obtain an adjusted flatness error $e_p$. The adjusted flatness error $e_p$ is to be construed as a parameterized flatness error, i.e. the adjusted flatness error $e_p$ is a parameterization of the flatness error e.

In order to determine the adjusted flatness error $e_p$, a mill matrix $G_m$ used in the control of the actuators, and which describes the steady state flatness response of the mill, is decomposed into its singular value decomposition form, as shown in equation (1).

$$G_m = U\Sigma V^T = [U_1 U_2]\begin{bmatrix} \Sigma_1 & 0 \\ 0 & \Sigma_2 \end{bmatrix}\begin{bmatrix} V_1^T \\ V_2^T \end{bmatrix} \approx U_1\Sigma_1 V_1^T \tag{1}$$

By means of the singular value decomposition of the mill matrix, the criterion in equation (2) includes terms that provide costs, i.e. weights, to the adjusted flatness error $e_p$, and the control outputs u to the actuators in directions corresponding to separate singular values of the mill matrix. Thereby, the control can become more robust in spite of a singular mill matrix.

The matrix $\Sigma$ is diagonal with the singular values of $G_m$ in its diagonal. The matrix $U_1$ is associated with the flatness effects provided by specific actuator position combinations, i.e. actuator configurations, which do provide a flatness effect to the roll gap and which are defined by the row vectors of the matrix $V_1^T$. Each direction of the matrix $V_1^T$, i.e. each row vector, thus represents a specific actuator position combination. The singular values which form the diagonal of the matrix $\Sigma_1$ represent the magnitude of the flatness effect for the actuator position combinations of the matrix $V_1^T$.

The matrix $V_2$ is associated with those actuator position combinations which do not provide any flatness effect and the singular values which form the diagonal of the matrix $\Sigma_2$ are close to zero or zero. In particular, the column vectors of the matrix $V_2$ span the null space of the mill matrix $G_m$. In practice, the singular values which are seen to be zero for control purposes may be those singular values which are below a predetermined flatness effect threshold value. As an example, singular values which are a factor $10^{-3}$ smaller than the largest singular value may be set to be zero. The column vectors of V which correspond to these singular values are hence defined to span the null space of the mill matrix $G_m$.

The adjusted flatness error $e_p$ is determined in a step S3 based on the minimization of equation (2) herebelow. The determining of the adjusted flatness error $e_p$ is based on the difference between a mapping of the adjusted flatness error $e_p$ by means of the mill matrix $G_m$, and the flatness error e, while adding costs, i.e. weights, to the adjusted flatness error and the control unit outputs u and respecting constraints to the control unit outputs. Such constraints may for instance be end constraints, i.e. minimum and maximum allowed positions or possible positions of the actuators. Constraints can also relate to rate constraints, i.e. how fast the actuators are allowed to move, or can move. Furthermore, constraints may relate to differences between actuator positions.

The error parameterization may be seen as a projection of the many original measurements onto exactly one measurement per actuator, which is normally a much lower number.

$$e_p(t) = \arg\left(\min_{u(t)\in allowed}(\|G_m e_p(t) - e(t)\|^2 + e_p(t)^T V Q_e V^T e_p(t) + u(t)^T V Q_u V^T u(t))\right) \quad (2)$$

The variable t in equation (2) indicates the time dependence of the flatness error e, the adjusted flatness error $e_p$, and the control unit outputs u.

The matrices $Q_e$ and $Q_u$ provide weights to all singular value directions of V for the adjusted flatness error $e_p$ and the outputs u of the control units. In other words, all singular value directions are considered for the weights, in particular in the directions which are associated with singular values which are effectively zero. Thus, also the directions of the null space of the mill matrix $G_m$ are under consideration when determining the adjusted flatness error $e_p$. Thereby all degrees of freedom, i.e. all possible actuator position combinations of the mill may be utilized, if needed. Normally, however, actuator position combinations which provide no flatness effect are however avoided. Such combinations will normally not minimize equation (1), but in case of actuator saturation for example, this may occur.

The matrices $Q_e$ and $Q_u$ may be diagonal matrices. Each actuator position combination may be individually weighted by means of $Q_e$ and $Q_u$.

The diagonal elements of $Q_e$ and $Q_u$ may be selected by a user, e.g. a commissioning engineer, of the mill 2 by means of a tuning process via a user interface when tuning the control system 25.

It is to be noted that the present method may be utilized also in mills which do not have a singular mill matrix by defining $Q_e$ and $Q_u$ to be zero in the tuning process.

The diagonal elements of the matrix $Q_e$ influence the feedback for disturbances in separate orthogonal directions according to the singular values. The first element is related to the highest singular value, which implies the direction where the process has the highest gain and is thus easiest to control, in the sense that it requires the least feedback gain. The following diagonal elements of the matrix $Q_e$ correspond to gradually lower singular values, thus needing higher feedback gain to reach the same degree of correction. Bad robustness may be the consequence when too high feedback gain is applied. Therefore, the choice of $Q_e$ has great influence on the robustness of the closed loop, since a positive element will reduce the gain. Hence, the elements of the matrix $Q_e$ are preferably positive, i.e. greater than zero or zero. Thereby, costs may be provided to singular value directions, i.e. for actuator position combinations which do not provide any flatness effect, or a flatness effect below the flatness effect threshold value in the criterion in equation (2) or (3) which is to be minimized.

The matrix $Q_e$ may be determined by means of iteration based on user-supplied parameters. A first parameter may relate to a maximum allowed peak value of the sensitivity function singular values. The sensitivity function provides a measure of the robustness of the control system, i.e. the sensitivity of the control system to modeling errors.

The first parameter may be given in the range 1.2 through 2.0. The lower values in the range mean higher robustness demand, while the higher values in the range allow some sacrifice in favor of higher disturbance rejection bandwidth.

A second parameter may relate to a maximum allowed cross interference, in percent, from a disturbance in one singular value direction to transient flatness errors in other singular value directions.

Each diagonal element of the matrix $Q_u$ determines the steady state closed loop gain from a flatness disturbance along one singular value direction to move the actuators along their corresponding singular value direction.

The matrix $Q_u$ may be determined by using iteration based on user-supplied parameters.

A first parameter may relate to the maximum allowed closed loop steady state gain from flatness disturbances to actuators in any direction. A second parameter may relate to a required steady state disturbance reduction, in percent, with gain restricted to the maximum allowed closed loop steady state gain from flatness disturbances to actuators in any direction, before control in that direction is abandoned.

Generally, a default value may be provided for the second of the above parameters for determining both $Q_e$ and $Q_u$. The first parameter in both cases above provides the user with suitable influence over the trade-off between allowable actuator movement and required performance.

One embodiment involves determining the adjusted flatness error by minimizing the expression herebelow.

$$e_p(t) = \arg\left(\min_{u(t)\in allowed}((G_m e_p(t) - e(t))^T Z (G_m e_p(t) - e(t)) + e_p(t)^T V Q_e V^T e_p(t) + + u(t)^T V Q_u V^T u(t) + u(t)^T Q_d u(t))\right) \quad (3)$$

In addition to the expression of equation (2) a matrix Z has been added, as well as the additional cost term to the control unit outputs u.

The matrix Z provides a weighting for the different sensors of the measurement device 23 in its diagonal. The weight can for instance depend on different widths of the sensors. In particular, laterally positioned sensors of the measurement device 23, i.e. sensors at the edge of the strip, may not be fully covered by the strip. Hence, it is the covered width that counts. These factors may be accounted for by means of the matrix Z.

It is to be noted that in one embodiment, the matrix Z may be utilized in the minimization of equation (2). In particular, the above expression may be utilized for determining the adjusted flatness error but not including the term $u^T Q_d u$.

The matrix $Q_d$ may be non-diagonal. $Q_d$ is normally a sparse matrix. The matrix $Q_d$ provides for optimization of actuator positions. A relation between some actuators may for instance be more favorable than others. It is by means of the term $Q_d$ possible to put a cost of e.g. having a difference between adjacent crown actuators for the segmented backup rolls.

In a step S4, the determined adjusted flatness error $e_p$ may be utilized by the control unit 33 to control the actuators A in order to achieve a desired flatness of the strip 7 being rolled in the mill 2.

Other applications of the method presented herein are also envisaged for multivariable control processes having a singular or near-singular matrix.

The skilled person in the art realizes that the present invention by no means is limited to the examples described hereabove. On the contrary, many modifications and variations are possible within the scope of the appended claims.

What is claimed is:

1. A method of providing flatness control for rolling a strip in a mill comprising a plurality of rolls controllable by means of actuators, the method comprising:

a) receiving flatness measurement data pertaining to a flatness of the strip from a plurality of sensors, b) determining a flatness error as a difference between a reference flatness of the strip and the flatness measurement data, c) determining an adjusted flatness error based on the flatness error and weights or actuator position combinations which provide a flatness effect below a threshold value and provide constraints to control unit outputs controlling the actuators, and d) controlling the actuators based upon the adjusted flatness error to thereby control the flatness of the strip, wherein step c) comprises using a mill matrix reflecting a steady state flatness response of the mill, decomposing the mill matrix into singular value decomposition form, and by means of the singular value decomposition of the mill matrix, providing costs to the adjusted flatness error and control unit outputs to the actuators in directions corresponding to separate singular values of the mill matrix.

2. The method of claim 1, wherein the determining in step c) comprises utilizing the flatness error to determine a difference between the flatness error and a mapping of the adjusted flatness error by means of a model representing the mill.

3. The method of claim 1, wherein in step c) the determining of the adjusted flatness error involves a minimization.

4. The method of claim 1, wherein the weights provide individual weights for each actuator position combination.

5. The method of claim 1, wherein in step c) the determining comprises providing additional weights to actuator position differences for optimizing the positioning between the actuators.

6. The method of claim 5, wherein the additional weights provide a penalty for differences in position between adjacent actuators.

7. The method of claim 1, wherein in step c) the determining comprises providing additional weights for deviations from preferred positions of actuators.

8. The method of claim 1, wherein in step c) the determining of the adjusted flatness error involves taking all possible actuator position combinations into account.

9. The method of claim 1, wherein the weights are adjustable by a user via a user interface.

10. The method of claim 1, wherein said constraints are based upon a minimum and a maximum allowed positions of the actuators.

11. The method of claim 1, wherein said constraints are based upon rate constraints of the actuators.

12. The method of claim 1, wherein said constraints relate to differences between positions of the actuators.

13. The method of claim 1, wherein each possible actuator position combination is usable in controlling the actuators.

14. The method of claim 1, wherein one of said constraints that controls one actuator of said actuators controls said one actuator without restricting movement of the other actuators.

15. A computer program product comprising a non-transitory computer readable medium storing program code which when executed performs a method of providing flatness control for rolling a strip in a mill comprising a plurality of rots controllable by means of actuators, comprising the steps of:

a) receiving flatness measurement data pertaining to a flatness of the strip from a plurality of sensors, b) determining a flatness error as a difference between a reference flatness of the strip and the flatness measurement data, c) determining an adjusted flatness error based on the flatness error and weights for actuator position combinations which provide a flatness effect below a threshold value and provide constraints to control unit outputs controlling the actuators, and d) controlling the actuators based upon the adjusted flatness error to thereby control the flatness of the strip, wherein step c) comprises using a mill matrix reflecting a steady state flatness response of the mill, decomposing the mill matrix into singular value decomposition form, and by means of the singular value decomposition of the mill matrix, providing costs to the adjusted flatness error and control unit outputs to the actuators in directions corresponding to separate singular values of the mill matrix.

16. A control system for providing flatness control for rolling a strip in a mill comprising a plurality of rolls controllable by means of actuators, wherein the control system comprises:

an input unit configured to receive measurement data pertaining to a flatness of the strip from a plurality of sensors;

a processing system configured to:

determine a flatness error as a difference between a reference flatness of the strip and the measurement data;

determine an adjusted flatness error based on the flatness error and weights for actuator position combinations which provide a flatness effect below a threshold value and provide constraints to control unit outputs controlling the actuators, wherein the processing system is configured to use a mill matrix reflecting a steady state flatness response of the mill, decompose the mill matrix into singular value decomposition form, and by means of the singular value decomposition of the mill matrix, provide costs to the adjusted flatness error and control unit outputs to the actuators in directions corresponding to separate singular values of the mill matrix; and a control unit having one control loop per actuator;

wherein the processing system is configured to provide the adjusted flatness error to the control unit;

wherein the control unit is configured to control the actuators based on the adjusted flatness error.

17. The control system of claim 16, wherein the control unit is configured to provide individual control outputs to each of the actuators.

18. The control system of claim 16, wherein the control unit does not utilize actuator position combinations which correspond to vectors or directions in the null space.

19. The control system of claim 16, wherein the weights provide individual weights for each actuator position combination.

* * * * *